US005827077A

United States Patent [19]

Fukuda

[11] Patent Number: 5,827,077

[45] Date of Patent: Oct. 27, 1998

[54] PRINTED CIRCUIT BOARD CONNECTOR WITH ALIGNMENT FEATURE

[75] Inventor: Eiji Fukuda, Shizuoka, Japan

[73] Assignee: Yazaki Corporation, Tokyo, Japan

[21] Appl. No.: 864,675

[22] Filed: May 28, 1997

[30] Foreign Application Priority Data

May 28, 1996 [JP] Japan ..... 8-133581

[51] Int. Cl.[6] ..... H01R 9/09

[52] U.S. Cl. ..... 439/79

[58] Field of Search ..... 439/79, 80, 381

[56] References Cited

U.S. PATENT DOCUMENTS 5,433,624 7/1995 Tabata ..... 439/381

FOREIGN PATENT DOCUMENTS 61-42887 3/1986 Japan .

3-26073 3/1991 Japan .

3-122979 5/1991 Japan .

*Primary Examiner*—Neil Abrams

*Assistant Examiner*—Barry M. L. Standig

*Attorney, Agent, or Firm*—Sughrue, Mion, Zinn, Macpeak & Seas, PLLC

[57] ABSTRACT

A printed circuit board connector including a housing to be fitted to a mating connector, and a plurality of conductive terminals having one end portions projecting into the interior of the housing so as to be connected to the mating connector, and the other end portions projecting outwardly from the housing. Alignment correction ribs are formed integrally on an outer surface of the housing in corresponding relation to the conductive terminals, and an alignment correction guide groove for fittingly receiving the associated conductive terminal is formed between any two adjacent ones of the alignment correction ribs. Each of the conductive terminals is bent in a direction of mounting on a printed circuit board when fitting it into the alignment correction guide groove.

4 Claims, 5 Drawing Sheets

PRINTED CIRCUIT BOARD CONNECTOR WITH ALIGNMENT FEATURE

BACKGROUND OF THE INVENTION

1. Field of the Invention

This invention relates to a printed circuit board connector to be mounted on a printed circuit board, and more particularly to a printed circuit board connector in which accurate terminal alignment can be easily secured.

2. Description of the Related Art

Heretofore, a connector has been mounted directly on a printed circuit board (PCB) in order to reduce the amount of connection wires and also to reduce the time and labor required. A printed circuit board connector, specially designed to be used in this construction, has an open portion for receiving a mating connector, and one end portions of a plurality of conductive terminals project into the open portion, while the other end portions of the conductive terminals project from a rear end surface of the connector and are bent to be directed toward the printed circuit board.

As shown in FIGS. 7 to 9, a printed circuit board connector 30 includes a housing 31 to be fitted on a mating connector (not shown), and a required number of conductive terminals 33 are integrally molded in the housing 31. The plurality of conductive terminals 33 project outwardly from the housing, and are passed respectively through mounting holes, formed at predetermined positions in a printed circuit board 10, and are fixedly secured to the board 10 by soldering or the like. At this time, in order to secure accurate alignment of the terminals 33, a terminal alignment correction plate 32 is mounted in the vicinity of a region where the conductive terminal 33 are connected to the printed circuit board 10.

Guide holes 34 are formed in the terminal alignment correction plate 32, and are arranged at predetermined positions corresponding respectively to the conductive terminals 33. The conductive terminals 33 are passed respectively through the guide holes 34, thereby securing the accurate alignment of the terminals.

With this terminal alignment correction plate 32, for example, a predetermined pitch X between the two adjacent terminals on a horizontal plane can be secured as shown in FIG. 8, and also a predetermined pitch Y between the two adjacent terminals in a forward-rearward direction can be secured as shown in FIG. 9 which is a cross-sectional view taken along the line G—G of FIG. 7. Therefore, the mounting of the terminals on the printed circuit board 10 can be effected efficiently, and also the durability of the terminals can be enhanced.

However, in the above conventional connector 30, the terminal alignment correction plate 32, which is a separate member from the housing 31, is mounted on the housing 31, and therefore the number of the component parts, as well as the time and labor required for the mounting operation, is increased, and much time and labor are required for assembling the connector 30, resulting in a problem that the cost is increased.

SUMMARY OF THE INVENTION

It is an object of this invention to provide a connector for a printed circuit board, in which each of conductive terminals can be located at its predetermined position at a predetermined pitch, and the accurate terminal alignment can be secured easily at low costs.

In order to achieve the above object, the invention provides a printed circuit board connector to be mounted at a predetermined position on a printed circuit board, comprising: a housing to be fitted to a mating connector; a plurality of conductive terminals having one end portions projecting into an interior of the housing so as to be connected to the mating connector, and the other end portions projecting outwardly from the housing; alignment correction ribs formed integrally on an outer surface of the housing in corresponding relation to the conductive terminals; and an alignment correction guide groove, formed between any two adjacent ones of the alignment correction ribs, for fittingly receiving one of the conductive terminals.

DETAILED DESCRIPTION OF THE PREFERRED EMBODIMENT

Figure 1:
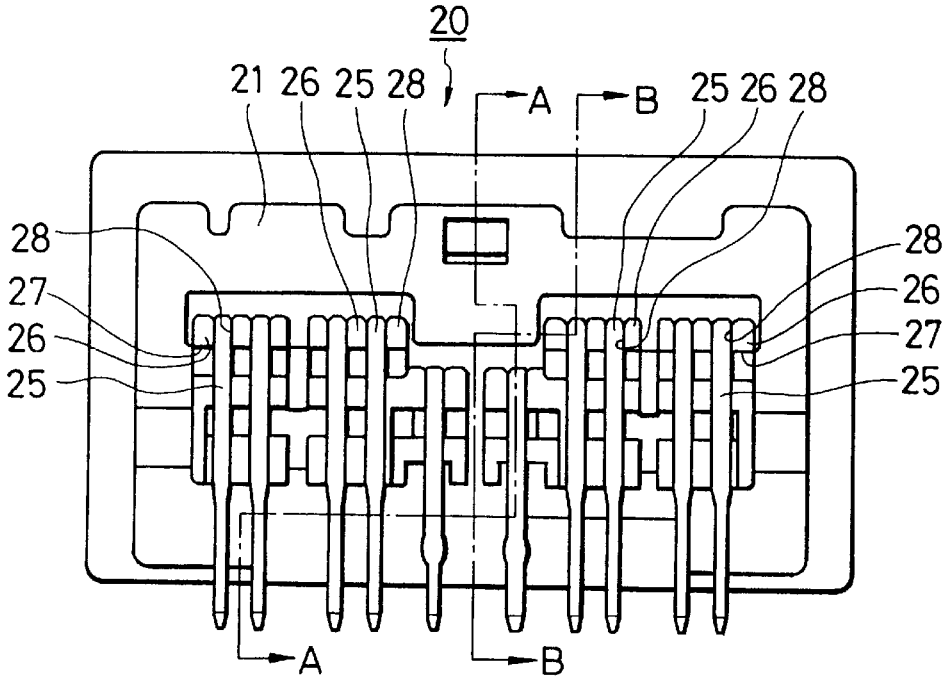
FIG. 1 is a front-elevational view of one preferred embodiment of a printed circuit board connector of the invention.
Figure 2:
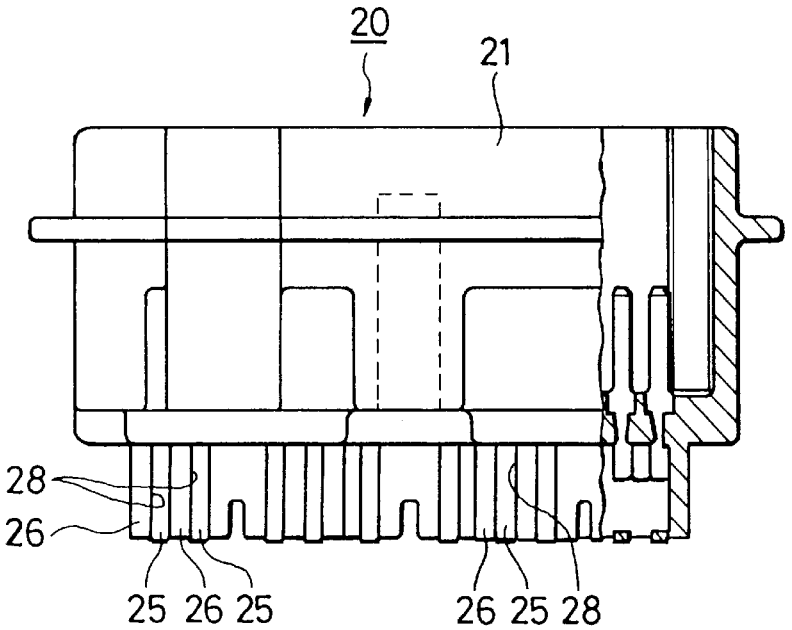
FIG. 2 is a plan view of the connector of FIG. 1.

One preferred embodiment of a printed circuit board connector of the present invention will now be described in detail with reference to FIGS. 1 to 6. FIG. 1 is a front-elevational view of one preferred embodiment of the printed circuit board connector of the invention, FIG. 2 is a plan view of the connector of FIG. 1, FIG. 3 is a cross-sectional view taken along the line A—A of FIG. 1, FIG. 4 is a cross-sectional view taken along the line B—B of FIG. 1, FIG. 5 is an enlarged, perspective view of an important portion of the connector, showing alignment correction guide grooves and alignment correction ribs, and FIG. 6 is an enlarged, front-elevational view of the portion of FIG. 5.

As shown in FIGS. 1 to 4, the printed circuit board connector 20 comprises a female housing 21, and a plurality of male conductive terminals 25. A plurality of terminal mounting holes 24 are formed in a vertical rear wall 23 of the housing 21 so as to extend horizontally, and the conductive terminals 25 are passed respectively through these terminal mounting holes 24. A plurality of alignment correction ribs 26, which are disposed rearwardly of the terminal mounting holes 24, and are spaced at predetermined intervals, are formed integrally with and extend from the housing 21 in corresponding relation to the conductive terminals 25. The alignment correction ribs 26 prevent the adjacent conductive terminals 25 and 25 from being short-circuited.

Figure 3:
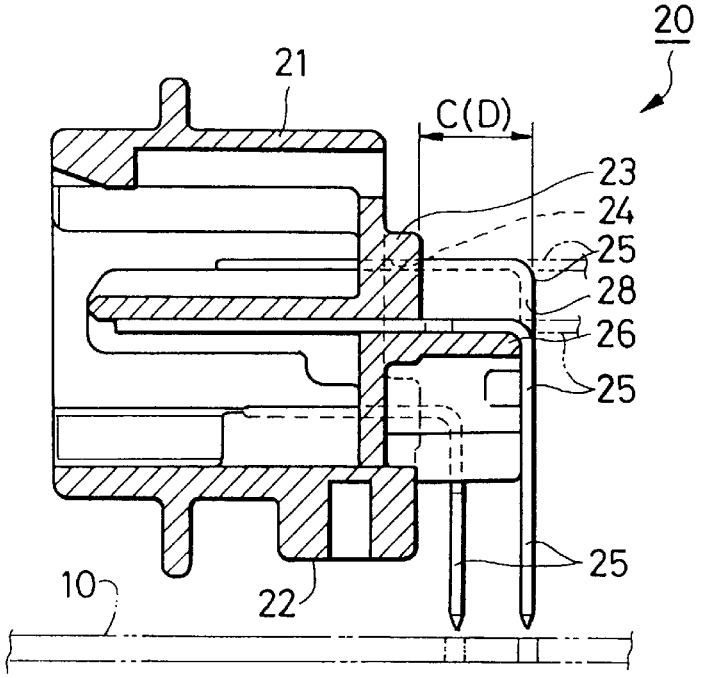
FIG. 3 is a cross-sectional view taken along the line A—A of FIG. 1.
Figure 4:
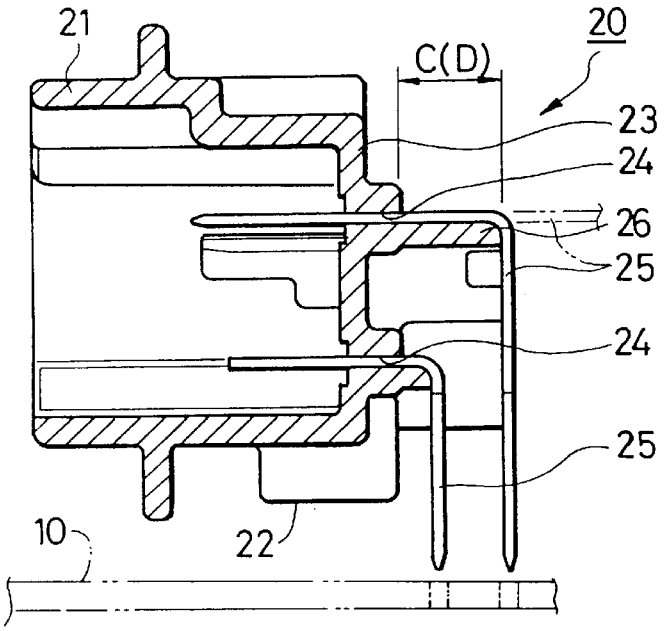
FIG. 4 is a cross-sectional view taken along the line B—B of FIG. 1.

As shown in FIGS. 3 and 4, an amount C of projection of the alignment correction ribs 26 from the vertical wall 23 is substantially equal to a distance D between the vertical wall 23 and a bent portion of the conductive terminals 25.

Figure 5:
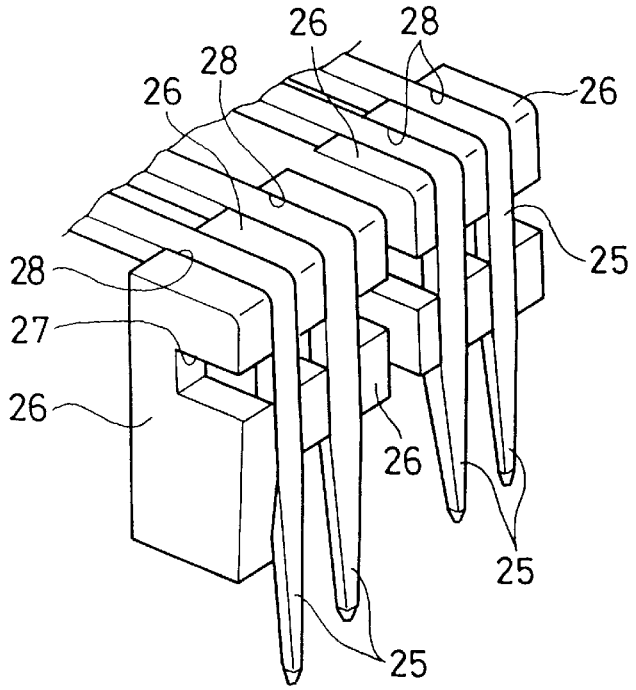
FIG. 5 is an enlarged, perspective view of an important portion of the connector of FIG. 1.
Figure 6:
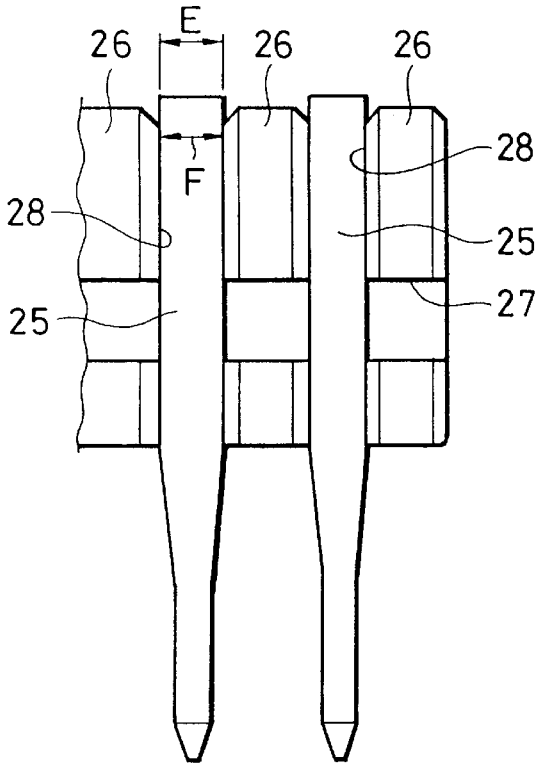
FIG. 6 is a front-elevational view of the portion of FIG. 5.
Figure 7:
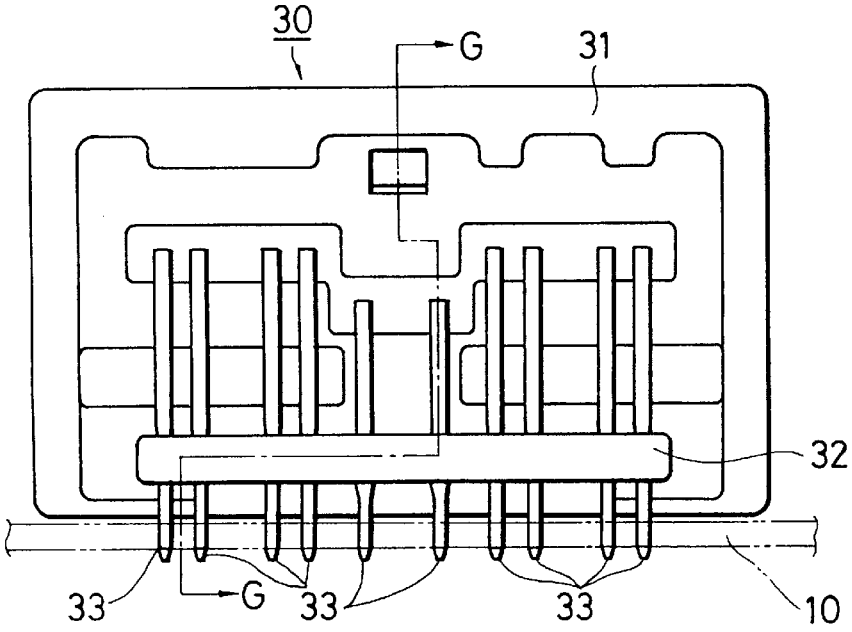
FIG. 7 PRIOR ART
FIG. 7 is a front-elevational view of a conventional printed circuit board connector.
Figure 8:
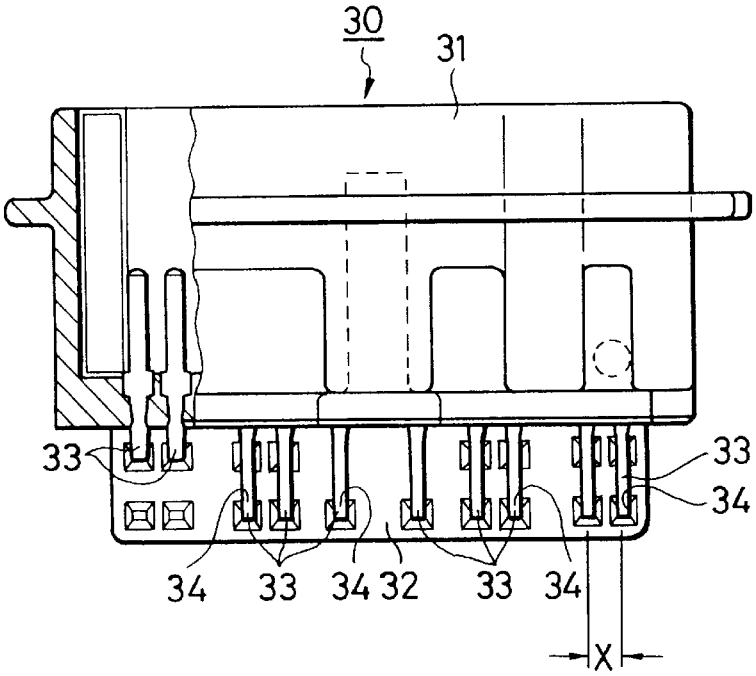
FIG. 8 PRIOR ART
FIG. 8 is a plan view of the connector of FIG. 7.
Figure 9:
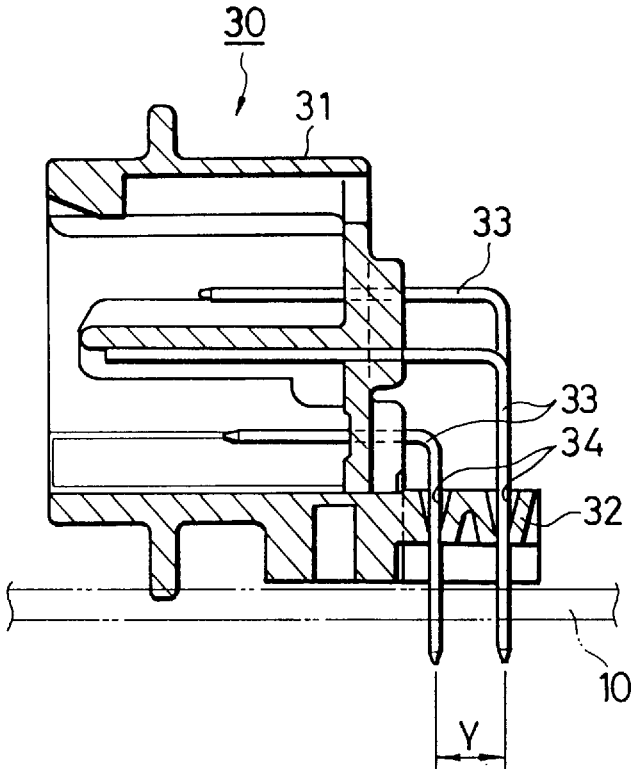
FIG. 9 PRIOR ART
FIG. 9 is a cross-sectional view taken along the line G—G of FIG. 7.

As shown in FIGS. 5 and 6, an alignment correction guide groove 28 is formed between any two adjacent alignment correction ribs 26 and 26. A width E of each alignment correction guide groove 28 is set to be slightly smaller than a width F of the conductive terminal 25.

Therefore, each conductive terminal 25 is press-fitted into the associated alignment correction guide groove 28, with the alignment correction ribs 26 slightly elastically deformed, so that the conductive terminal 25 is held in the alignment correction guide groove 28 to be located accurately at a predetermined position.

A cut portion 27 is formed in each alignment correction rib 26 so as to extend therethrough in a direction of the width of the housing 21. When water intrudes into the alignment correction guide grooves 28 during washing of the connector 20, the water is removed by the air or the like through the cut portions 27.

One end portions of the conductive terminals 25, mounted on the housing 21, project a predetermined amount into the interior of the housing 21, and are connected respectively to mating terminals when a mating connector (not shown) is fitted into the housing 21. The other end portions of the terminals 25 project a predetermined amount from the rear end of the housing 21, and are bent substantially perpendicularly in a direction of mounting on a printed circuit board 10.

Therefore, at the stage of passing the conductive terminals 25 through the respective terminal mounting holes 24, each conductive terminal 25 is in the form of a straight bar, and then is bent substantially perpendicular at the stage of press-fitting the conductive terminal 25 in the alignment correction guide groove 28.

The procedure of mounting the above printed circuit board connector 20 will now be described.

First, as shown in FIGS. 3 and 4, the one end portions of the bar-like conductive terminals 25 are passed respectively through the terminal mounting holes 24 from the rear side of the housing 21, and are projected a predetermined amount into the interior of the housing 21. Then, the other end portions of the terminals are bent perpendicularly along the alignment correction guide grooves 28, respectively, and are firmly press-fitted respectively in the alignment correction guide grooves 28 at a final stage of this bending operation.

Each of the alignment correction guide grooves 28 is formed between the alignment correction ribs 26 and 26 formed it integrally with the housing 21, and therefore the conductive terminals 25 are positively located at their respective predetermined positions at the predetermined pitch, so that the accurate terminal alignment is secured.

Further, each of the conductive terminals 25 can be suitably bent simultaneously when press-fitting it into the alignment correction guide groove 28, and therefore the efficiency of mounting the conductive terminals on the housing can be enhanced.

Then, a mounting surface 22 of the housing 21 is abutted against the printed circuit board 10, so as to be mounted thereon, and also the other end portions of the conductive terminals 25 are passed respectively through mounting holes formed in the printed circuit board 10, and are soldered thereto, or connected to another connector on the printed circuit board 10.

As described above, in the above embodiment, each of the alignment correction guide grooves 28 is formed between the alignment correction ribs 26 and 26 formed integrally with the housing 21, and each of the conductive terminals 25, when bent, is press-fitted into the associated alignment correction guide groove 28, and therefore the accurate terminal alignment can be secured at low costs.

Namely, a terminal alignment correction plate or the like which is a separate member from the housing as in the conventional construction is not needed, and therefore the number of the component parts, as well as the time and labor required for the mounting operation, can be reduced, and the mounting of the connector can be effected efficiently in a short time. As a result, the production cost can be reduced, and besides a problem with the precision of mounting of the terminal alignment correction plate on the housing is not encountered, thereby the accurate terminal alignment can be easily secured.

Further, thanks to the provision of the alignment correction ribs, the adjacent conductive terminals, fitted in the respective alignment correction guide grooves, are positively prevented from being short-circuited.

In the above embodiment, each conductive terminal is bent when press-fitting it into the alignment correction guide groove. However, it is, of course, possible that when the front end portion of the conductive terminal, beforehand bent perpendicularly as in the conventional construction, is passed through the terminal mounting hole in the rear end of the housing, the rear end portion of the conductive terminal is press-fitted into the alignment correction guide groove.

Furthermore, there can be used an arrangement in which the terminal mounting holes are not formed in the housing, and the bar-like conductive terminals are insert-molded in the housing when molding the housing.

As described above, in the printed circuit board connector of the present invention, the alignment correction ribs are formed integrally on the outer surface of the housing in corresponding relation to the conductive terminals, and the alignment correction guide groove for fittingly receiving the associated conductive terminal is formed between any two adjacent ones of the alignment correction ribs.

Therefore, the conductive terminals can be easily located respectively at the predetermined positions at the predetermined pitch, and the accurate terminal alignment can be secured at low costs.

Each of the conductive terminals is bent in the direction of mounting on the printed circuit board when fitting it into the alignment correction guide groove, and therefore the number of the component parts, as well as the time and labor required for the mounting operation, is reduced, and in cooperation with the above effect, the efficiency of the connector mounting operation can be enhanced.

What is claimed is:

1. A printed circuit board connector to be mounted at a predetermined position on a printed circuit board, comprising:

a housing to be fitted to a mating connector;

a plurality of conductive terminals having one end portion projecting into an interior of said housing so as to be connected to the mating connector, and another end portion projecting outwardly from said housing;

alignment correction ribs formed integrally on an outer surface of said housing in corresponding relation to said conductive terminals; and an alignment correction guide groove, formed between any two adjacent ones of said alignment correction ribs, for fittingly receiving one of said conductive terminals, wherein said alignment correction ribs and said alignment correction guide groove position said conductive terminals in both the longitudinal and lateral directions.

2. The printed circuit board connector according to claim 1, wherein each of said conductive terminals is bent in a direction of mounting on the printed circuit board when fitting it into said alignment correction guide groove.

3. The printed circuit board connector according to claim 1, wherein a width of said alignment correction guide groove is set to be slightly smaller than a width of the one of said conductive terminals.

4. The printed circuit board connector according to claim 1, wherein a cut portion is formed at an outer edge in each of said alignment correction ribs so as to extend therethrough in a direction of a width of said housing, for facilitating the removal of water which collects in said alignment correction grooves.

* * * * *